US009453505B2

(12) United States Patent
Stephens et al.

(10) Patent No.: US 9,453,505 B2
(45) Date of Patent: Sep. 27, 2016

(54) METHODS AND SYSTEMS FOR MONITORING A POWER SUPPLY FOR A FIRE PUMP MOTOR

(71) Applicant: ASCO Power Technologies, L.P., Florham Park, NJ (US)

(72) Inventors: Douglas A. Stephens, Cary, NC (US); Harlan A. Rosenthal, Fairlawn, NJ (US)

(73) Assignee: ASCO POWER TECHNOLOGIES, L.P., Florham Park, NJ (US)

( * ) Notice: Subject to any disclaimer, the term of this patent is extended or adjusted under 35 U.S.C. 154(b) by 341 days.

(21) Appl. No.: 13/908,922

(22) Filed: Jun. 3, 2013

(65) Prior Publication Data

US 2013/0343910 A1 Dec. 26, 2013

Related U.S. Application Data

(60) Provisional application No. 61/656,749, filed on Jun. 7, 2012.

(51) Int. Cl.
*F04B 49/06* (2006.01)
*F04B 17/03* (2006.01)

(52) U.S. Cl.
CPC ..... *F04B 49/06* (2013.01); *F04B 17/03* (2013.01); *F04B 49/065* (2013.01); *F04B 2203/0201* (2013.01); *F04B 2203/0202* (2013.01)

(58) Field of Classification Search
CPC ..... F04B 49/065; F04B 49/06; F04B 17/03; F04B 2203/0201; F04B 2203/0202; F04B 2270/70; F04B 51/00; F04D 27/001; F04D 27/02; F04D 27/0292; F04D 27/00; F04C 2270/78; F04C 2270/80
USPC ..... 417/63; 318/400.12, 420, 568.25; 340/648; 361/30
See application file for complete search history.

(56) References Cited

U.S. PATENT DOCUMENTS 3,748,656 A 7/1973 Gray et al.
5,035,357 A 7/1991 Brickell et al.
(Continued)

FOREIGN PATENT DOCUMENTS

EP 1702655 A1 9/2006
JP 2009008091 A1 1/2009

OTHER PUBLICATIONS

Firetrol, Inc., Instructions, Digital Pressure Monitor, FTA470, Publication NS470-01 Rev. A (Oct. 20, 2000).
(Continued)

*Primary Examiner* — Bryan Lettman
*Assistant Examiner* — Philip Stimpert
(74) *Attorney, Agent, or Firm* — McDonnell Boehnen Hulbert & Berghoff LLP

(57) ABSTRACT

Methods and systems for operating a fire pump controller are provided. An example method includes causing a power supply coupled to a an electric motor-driven water pump through a fire pump controller in a fire protection system to provide power to the water pump, and monitoring the performance of the power supply during the motor starting period by measuring the voltage and/or current of its output under motor load conditions. The method may also include providing visual indications, such as traces or starting signatures of motor power supply voltages and/or currents during the motor starting period for the purposes of observation and troubleshooting motor power supply and power train performance problems.

15 Claims, 13 Drawing Sheets

(56) References Cited

U.S. PATENT DOCUMENTS

| | | | |
|---|---|---|---|
| 5,236,049 | A | 8/1993 | Asselin et al. |
| 5,460,196 | A | 10/1995 | Yonnet |
| 5,577,890 | A | 11/1996 | Nielsen et al. |
| 5,729,698 | A | 3/1998 | Stelter |
| 5,950,150 | A | 9/1999 | Lloyd et al. |
| 5,982,274 | A | 11/1999 | Stelter et al. |
| 6,221,263 | B1 | 4/2001 | Pope et al. |
| 6,273,686 | B1 | 8/2001 | Kroell et al. |
| 6,856,251 | B1 | 2/2005 | Tietsworth et al. |
| 6,992,590 | B1 | 1/2006 | Tietsworth et al. |
| 2005/0183868 | A1* | 8/2005 | Taylor ..... A62C 37/44 169/51 |
| 2010/0138054 | A1 | 6/2010 | Goupil |

OTHER PUBLICATIONS

Torna Tech, JP Model, Jockey Pump Controller, Full voltage across the line starter Mico Processor Based, JP-BRO-001/E Rev.4 (Sep. 4, 2003).

U.S. Appl. No. 12/626,781, Office Action dated Sep. 30, 2011 (Sep. 30, 2011).

U.S. Appl. No. 12/626,781, Office Action dated Jun. 8, 2012 (Jun. 8, 2012).

* cited by examiner

Fire Pump Controller Power Train
FTA1000 Full Voltage Start

Fire Pump Controller Power Train
FTA1250 Part Winding Start

Fire Pump Controller Power Train
FTA1300 Wye-Delta Open Transition Start

Fire Pump Controller Power Train
FTA1500 Primary Resistor Start

Fire Pump Controller Power Train
FTA1800 Autotransformer Start

Fire Pump Controller Power Train
FTA1930 Digital Soft Start

METHODS AND SYSTEMS FOR MONITORING A POWER SUPPLY FOR A FIRE PUMP MOTOR

CROSS-REFERENCE TO RELATED APPLICATION

This application is a non-provisional of U.S. Provisional Patent Application No. 61/656,749, filed Jun. 7, 2012, which is incorporated herein by reference in its entirety.

BACKGROUND

Sprinkler systems are installed in buildings to reduce destruction caused by fires. A fire protection system may comprise a sprinkler system and/or a standpipe system. A sprinkler system is an active fire protection measure that provides adequate pressure and flow to a water distribution piping system, onto which a plurality of fire sprinklers is connected. Each closed-head sprinkler can be triggered once an ambient temperature around the sprinkler reaches a design activation temperature of the individual sprinkler head. In a standard wet-pipe sprinkler system, each sprinkler activates independently when the predetermined heat level is reached. Because of this, the number of sprinklers that operate is limited to only those near the fire, thereby maximizing the available water pressure over the point of fire origin. A standpipe system is another type of fire protection measure consisting of a network of vertical piping installed in strategic locations within a multi-story building. The vertical piping may deliver large volumes of water to any floor of the building to supply hose lines of firefighters, for example.

FIG. 1 illustrates a block diagram of a prior art fire pump installation 100. The fire pump installation 100 includes an electric motor driven fire pump 102 which is driven by an electric motor. The electric motor driven fire pump is further connected to a water source 104. The water source 104 provides water flow at a pressure to a fire protection system 106. Generally, fire pumps are needed when a water source cannot provide sufficient pressure to meet hydraulic design requirements of a fire protection system. This usually occurs in a building that is tall, such as a high-rise building, or in a building that requires a relatively high terminal pressure in the fire protection system 106 to provide a large volume of water, such as a storage warehouse. Thus, the fire pump 102 may be installed to boost the water source supply line pressure and maintain system pressure to meet the pressure and flow demands of the fire protection system 106.

The electric motor driven fire pump 102 starts under operation of the electric motor when a pressure in the fire protection system 106 drops below a certain predetermined start pressure. A pressure sensing line 118 is provided which allows the fire pump controller 110 to monitor system pressure. For example, the pressure in the fire protection system 106 may drop significantly when one or more fire sprinklers are exposed to heat above their design temperature, and open, releasing water. Alternately, fire hose connections to standpipe systems may be opened by firefighters causing a pressure drop in the fire protection system 106. In one instance, the fire pump may have a rating between 3 and 3500 horsepower (HP).

The fire pump installation 100 also includes an electric motor driven pressure maintenance pump, which also may be referred to as a make-up pump or a jockey pump 108. Operatively coupled to an electric motor, the jockey pump 108 is intended to maintain pressure in the fire protection system 106 so that the electric motor and hence the fire pump 102 does not need to constantly run. A pressure sensing line 120 is provided which allows the jockey pump controller 108 to monitor system pressure. For example, the jockey pump 108 maintains pressure to an artificially high level so that the operation of a single fire sprinkler will cause a pressure drop that will be sensed by a fire pump controller 110, causing the fire pump 102 to start. In some examples, the jockey pump 108 may have a rating between ¼ and 100 HP.

In one example, the jockey pump 108 may provide makeup water pressure for normal leakage within the system (such as packing on valves, seepage at joints, leaks at fire hydrants) and inadvertent use of water from the water source 104. When the fire pump 102 starts, a signal may be sent to an alarm system of a building to trigger a fire alarm. Nuisance operation of the fire pump 102 (as well as the electric motor operating the fire pump 102) may eventually cause fire department intervention and increase wear on the fire pump 102. Thus, it is generally desired to either reduce and/or avoid any nuisance or unintended operation of the fire pump 102 and accompanying fire pump motor.

The jockey pump 108 may also include a jockey pump controller 112. Each of the fire pump controller 110 and jockey pump controller 112 may comprise a microprocessor-based controller that can be used to adjust start and stop set points. For example, the fire pump controller 110 may automatically cause the fire pump 102 to start or the jockey pump controller 112 may automatically cause the jockey pump 108 to start when a water pressure is below a pressure set point. The jockey pump controller 112 may have a start pressure set point of approximately five to ten pounds per square inch (psi) greater than the start pressure point of the fire pump controller 110. In this manner, the jockey pump controller 112 cycles the jockey pump to maintain the fire protection system 106 at a predetermined pressure well above the start setting of the fire pump 102 so that the fire pump 102 only runs when a fire occurs or the jockey pump 108 is overcome by a larger than normal loss in system pressure.

The fire installation system 100 also includes check valves 114 and gate valves 116. The check valves 114 are used in the fire pump installation 100 to allow the flow of water in one direction only for the purpose of building pressure in the fire protection system 106. Check valves 114 are installed between the outlets of each of the fire pump 102 and jockey pump 108, and the fire protection system 106. The gate valves 116 are installed on the inlets and outlets of each of the fire pump 102 and jockey pump 108 and are used to isolate either the fire pump 102 or jockey pump 108 from the fire protection system 106 and water source 104 for maintenance or other purposes.

SUMMARY

In one example aspect, a method is provided that comprises causing a power supply coupled to an electric motor-driven water pump in a fire protection system to provide power to the water pump, and monitoring the performance of the power supply during a motor starting period by measuring the voltage and/or current of its output under motor load conditions. The method also comprises providing, by a computing device, at least one visual indication, such as a trace of power supply voltage and/or current output during the motor starting period. Such traces may also be referred to as a motor starting signature.

In another example, a non-transitory computer-readable medium having stored therein instructions that when executed by a computing device cause the computing device to control operation of a fire pump of a fire pump system is provided. The instructions are effective to cause the computing device to perform functions comprising causing a power supply coupled to an electric motor-driven water pump in a fire protection system to provide power to the water pump, monitoring the performance of the power supply during the motor starting period by measuring the voltage and/or current of its output under motor load conditions, and visual indications, such as traces of power supply voltage and/or current output during the motor starting period.

In still another example, a fire pump controller configured to operate in a fire protection system is provided. The fire pump controller comprises a processor configured to monitoring the performance of the power supply during the motor starting period by measuring the voltage and/or current of its output under motor load conditions that is coupled to an electric motor-driven water pump in the fire protection system. The power supply is configured to provide power to the water pump. The processor is also configured to provide visual indications, such as traces of power supply voltage and/or current output during the motor starting period.

In yet another example, a fire protection system is provided that comprises an electric motor-driven water pump and a power supply coupled to the motor through a pump controller. The water pump is configured to boost and maintain the water pressure in the fire protection system, and the power supply is configured to provide power to the water pump. The pump controller is configured to cause the power supply to provide power to the water pump and to provide visual indications, such as traces of power supply voltage and/or current output during the motor starting period.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1:
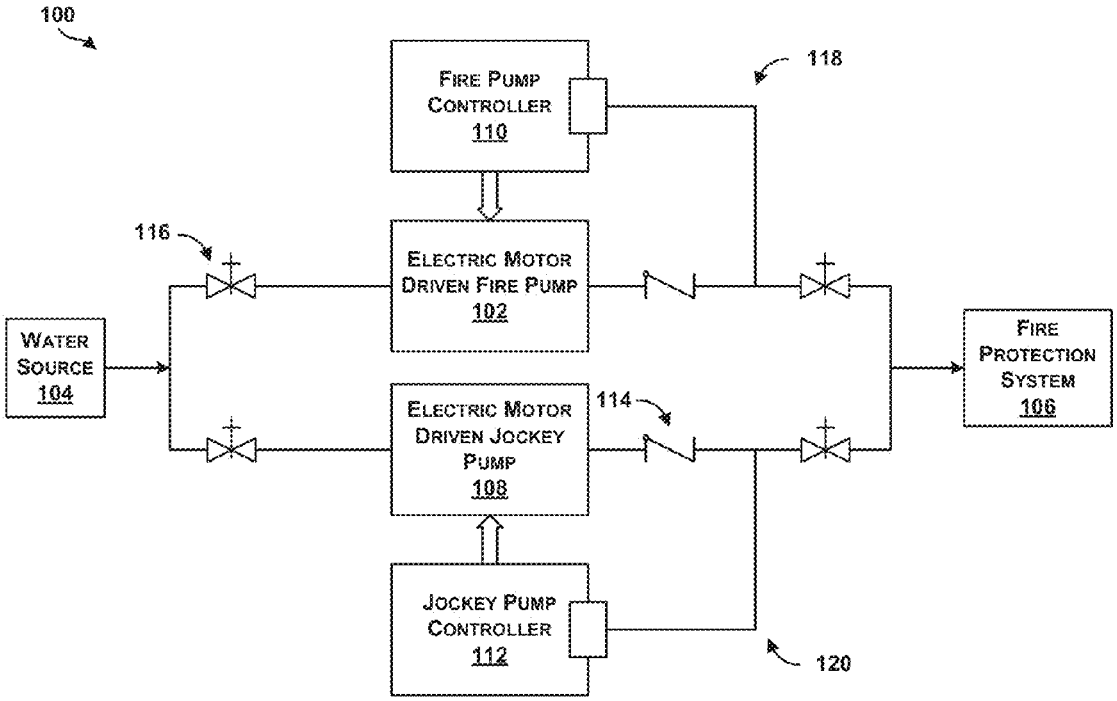
FIGURE 1 PRIOR ART
FIG. 1 illustrates a block diagram of a prior art fire pump installation.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Figure 2:
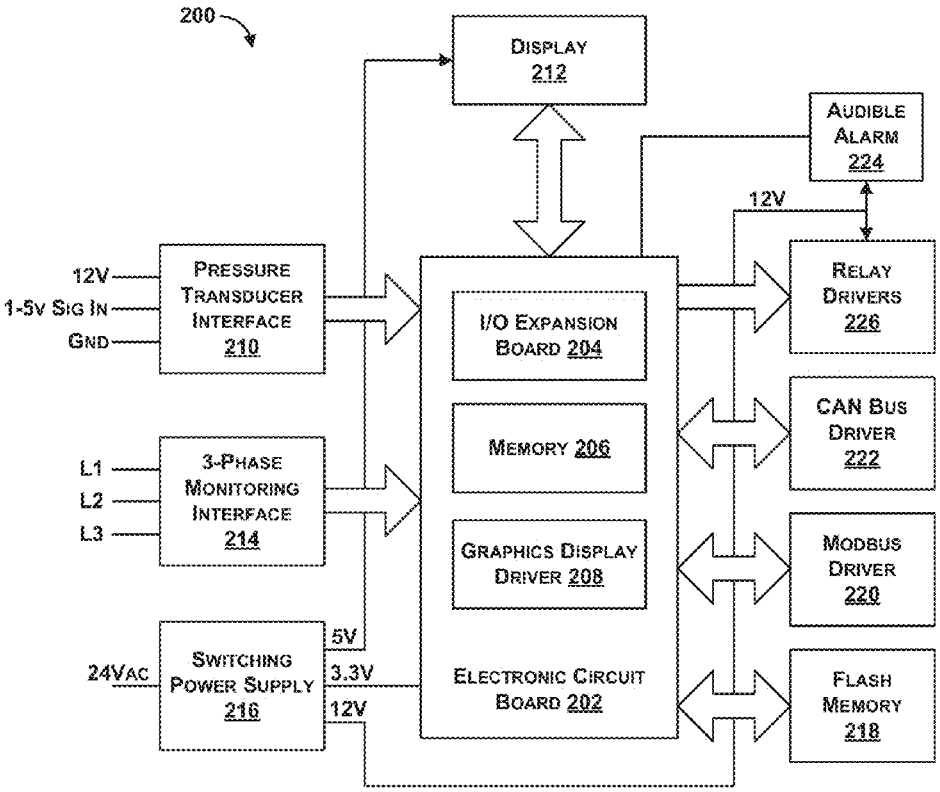
FIG. 2 is a block diagram illustrating an example pump controller system configured to control a pump to boost and/or maintain water pressure within a water system.

Example devices, systems, and methods disclosed herein relate to methods and systems for operating a fire pump controller are provided. An example method includes causing a power supply coupled to a water pump motor and a water pump in a fire protection system to provide power to the water pump, and monitoring the performance of the power supply during the water pump motor starting period by measuring the voltage and/or current of its output under motor load conditions. The method may also include providing visual indications, such as traces of power supply voltage and/or current output during the water pump motor starting period Referring again to the figures, FIG. 2 is a block diagram illustrating an example pump controller system 200 configured to control a pump to boost and/or maintain water pressure within a water system. For example, the water system may be the fire protection system 106 of FIG. 1, and the pump controller system may be one or more components of the system 100. In some examples, the system 200 may include one or more functional or physical components, such as an electronic circuit board 202 and a pressure transducer interface 210. One or more of the described functional or physical components may be divided into additional functional or physical components, or combined into fewer functional or physical components. Additionally, the system 200 may include more or less functional and/or physical components.

In some examples, the electronic circuit board 202 of the system may optionally include an input/output (I/O) expansion board 204. For instance, a ribbon cable may connect the electronic circuit board 202 to the I/O expansion board 204, and the I/O expansion board 204 may be configured to provide additional processing capabilities for the electronic circuit board 202. The electronic circuit board 202 and/or the I/O expansion board 204 may be or may include a microprocessor, or functions of the electronic circuit board 202 and/or the I/O expansion board 204 may be performed by a microprocessor. Depending on the desired configuration, any type of microprocessor(s) may be included, including but not limited to a microprocessor, a microcontroller, a digital signal processor, or any combination thereof. The electronic circuit board 202 and/or the I/O expansion board 204 may include one or more levels of caching, a processor core, and registers. The processor core can include an arithmetic logic unit, a floating point unit, a digital signal processing core, or any combination thereof. In one example, the microprocessor comprises a TMS470-based microcontroller. In some examples, the functions of the microprocessor may be provided by multiple microprocessors.

The electronic circuit board 202 may also include a memory 206, such as for example, volatile memory (e.g., random access memory), non-volatile memory (e.g., read only memory, flash memory, etc.) or any combination thereof. The memory 206 may include stored software applications, and the electronic circuit board 202 or components of the electronic circuit board 202 may be configured to access the memory 206 and execute one or more of the software applications stored therein. Additionally, the electronic circuit board 202 may include a graphics display driver 208, utilized to drive a display 212 of the system or an external display for a PC, laptop, video monitor, television, or similar monitor device. Such displays may be provided locally at a location of the system 200 or remotely.

The electronic circuit board 202 may receive electronic signals from the pressure transducer interface 210 indicating a pressure value, and compare the pressure value to a set point for starting or stopping a pump motor. For example, the system 200 may be a fire pump controller controlling a motor of a fire pump or a jockey pump controller controlling a motor of a jockey pump. In one example, the electronic circuit board 202 may output a pump run signal to energize a motor contactor coupled to the pump motor.

The pressure transducer interface 210 may be configured to receive a signal from a pressure transducer. For instance, the pressure transducer may be any type of pressure sensor which may generate a signal as a function of an imposed pressure, and provide an input to the electronic circuit board 202 via the pressure transducer interface 210. As such, the pressure transducer may be positioned in a water system to generate signals as a function of a suction pressure at the inlet of the pump, a discharge pressure at the outlet of a pump, an overall system pressure, or other water pressure. The pressure transducer may be any kind of pressure sensor that may measure any type of pressure, such as an absolute pressure, a gauge pressure, a differential pressure, or a sealed pressure, for example.

In one example, the pressure transducer may be an electronic pressure sensor using a linear variable differential transformer (LVDT) coupled to a bourbon tube. In other examples, the pressure transducer may be a solid state pressure sensing device, an electromechanical pressure sensing device, or a combination of the two. For example, the solid state pressure sensing device may comprise a semiconductor pressure transducer that includes an integrated circuit having a four resistor bridge implanted on a silicone membrane.

In some examples, the pressure transducer may include a range of 0-300 psi, 0-600 psi, or 0-1000 psi for fresh water service, sea water/foam service, or other service. Other example pressure ranges within or outside of the example pressure ranges are also possible. In one instance, the pressure transducer interface may provide an analog voltage of about 1-5 volts of direct current that can be interpreted by the pressure transducer interface 210 or the electronic circuit board 202 as indicating a corresponding water pressure between 0-600 psi.

In some instances, the pressure transducer may be included within an enclosure of the system 200. In other instances, the pressure transducer may be mounted outside the enclosure of the system 200 and is operationally coupled to the system 200.

The system 200 may further include a three-phase monitoring interface 214 that may provide inputs to the electronic circuit board 202 or components of the electronic circuit board 202. For example, the three-phase monitoring interface 214 may monitor a three-phase power line for detection of phase failure or phase reversal. As an example, the electronic circuit board 202 may receive a signal(s) from the three-phase monitoring interface 214 and a microprocessor may determine whether there is a valid supply line with all three phases present, a correct phase rotation, and a proper frequency.

The electronic circuit board 202 may be powered by a switching power supply 216 that is configured to receive three-phase incoming line voltages directly from power supply 314 (such as 200-600 Vac 50/60 hertz) or powered through a single-phase step-down transformer converting line voltage to 24 Vac. Additionally, the power switching supply 216 may provide voltages such as 5 volts, 3.3 volts, or 12 voltages to components of the system 200. Other voltages are also possible.

In some examples, the electronic circuit board 202 may receive or output information (such as analog and/or digital signals) from or to components of the system 200. For example, a microprocessor may receive inputs or configuration settings via a user interface or input device. In other examples, the electronic circuit board 202 may communicate with a flash memory 218 to store operating conditions of the system 200 or communicate using one or more of a Modbus driver 220, controller area network (CAN) bus driver 222, or other communication component. Serial network communications may take place, for example, with other systems 200 or a local or remote computing device. Other communication interface drivers may also provide for communication using Modbus Ethernet, CANOpen, wired or wireless Ethernet, DeviceNet, ProfiBus, BACNet, ARCNet, ZigBee, Bluetooth, Wi-Fi, and other similar protocol structures.

The electronic circuit board 202 or components of the electronic circuit board 202 may also output signals to an audible alarm 224 or the display 212 to provide audible or visual indications of operation of the system 200, for example.

The electronic circuit board 202 or components of the electronic circuit board 202 may also output to relay drivers 226 for operating drivers to actuate relays. For instance, a microprocessor may output a pump run signal for operating a pump motor on the three-phase incoming line, such as by initializing the three-phase incoming line to provide power to the pump motor. In one example, the relay drivers 226 may be instructed to operate the relays until a signal is received from the electronic circuit board 202 indicating that a pressure value is satisfied and a minimum run timer has expired. The relays may include any type of switch or electrically operated switch, for example.

In some examples, a microprocessor of the electronic circuit board 202 may implement a control sequence by way of a software-based state machine. In one state machine arrangement, the state machine comprises at least three states: an Idle, a Starting State, and a Running State. For example, in the Idle State, a pump motor will not be energized and hence the pump will not be running. However, in one operational arrangement, the state machine monitors various discrete and measured data points to determine whether conditions exist to advance to a subsequent state, such as the Starting State.

During the Starting State, the control logic of the microprocessor will account for timers and/or configuration options that might be intended to delay or inhibit a state transition. The Starting State contains the logic associated with the proper startup of a pump. A successful detection of an active pump may cause the state to transition to the Running State. Failure to start the pump or pumps will likewise be detected and may result in certain alarm indications. As just one example, a failure to start alarm may be declared if a 24 Vac signal is not received from an auxiliary contact within a certain predetermined time frame (e.g., within 1 second of energizing).

In the Running State, the pump will be active. During the Running State, the state machine can monitor various discrete and measured data points to determine whether conditions exists to stop the pump and, as such, advance the control to an Idle State. During the Running State, the microprocessor based logic will also account for any timers or configuration options intended to delay or inhibit a state transition of the pump.

The system 200 may also comprise a plurality of programmable timers. In one system arrangement, control sequence timers may be provided. The control sequence timers may interact with the pump control state machine and may comprise either an On Delay Timer or a Minimum Run Timer. The On Delay Timer can be used to guard against nuisance activations of the pump due to pressure excursions such as water hammer. The Minimum Run Timer may be used to specify a minimum length of time the pump is kept running. For example, the system 200 can be programmed so that it can keep the pump running until the minimum run timer has expired and a STOP pressure within a fire protection system has been maintained and is therefore satisfied.

Figure 3:
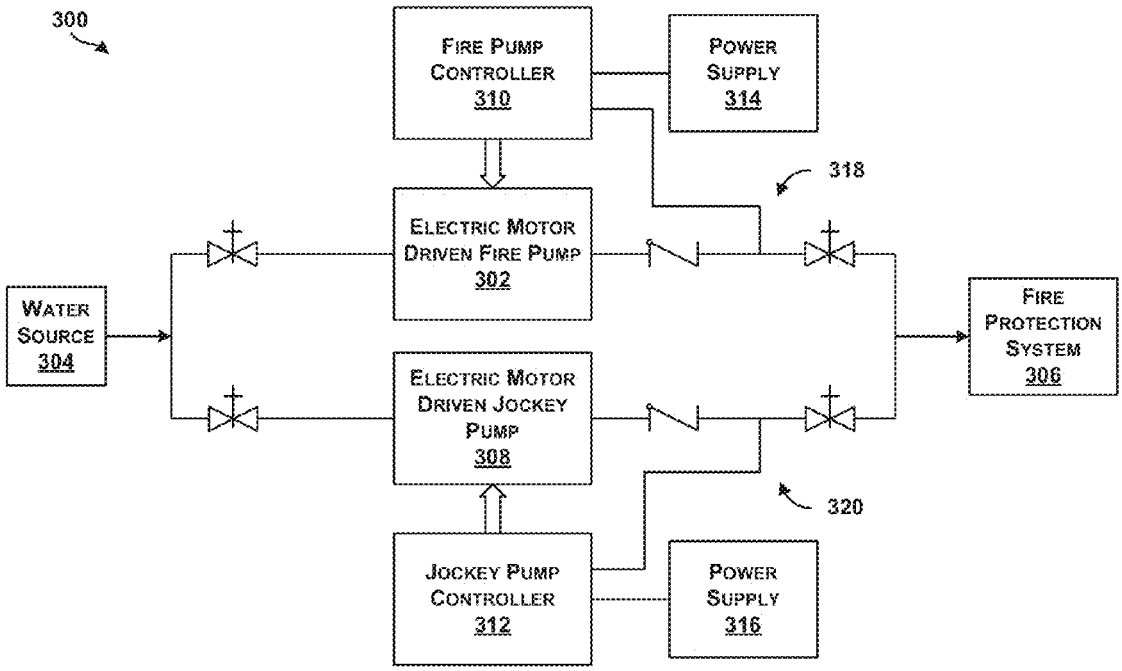
FIG. 3 illustrates a block diagram of an example fire pump system.

FIG. 3 illustrates a block diagram of an example fire pump system 300. The fire pump system 300 includes an electric motor-driven fire pump 302 that is connected to a water source 304. The water source 304 provides water flow to fire pump 302 which boosts and maintains system pressure in the fire protection system 306 to satisfy the demand for pressure and flow via sensing line 318. The fire pump system 300 also includes a jockey pump 308. Each of the fire pump 302 and the jockey pump 308 has an associated controller (e.g., fire pump control 310 and jockey pump controller 312) for sensing system pressure via sensing line 320. Further, a power supply 314 is coupled through fire pump controller 310 to the fire pump 302 to provide power to the fire pump 302. Coupling fire pump 302 to power supply 314 through fire pump controller 310 permits fire pump controller 310 to control the fire pump motor and to monitor the performance of the power supply during the motor starting period by measuring the voltage and/or current of its output under motor load conditions. Similarly, a power supply 316 is coupled through jockey pump controller 312 to the jockey pump 308 to provide power to the jockey pump 308. Coupling jockey pump 308 to power supply 316 through jockey pump controller 312 permits jockey pump controller 312 to control the jockey pump motor and to monitor the performance of the power supply during the motor starting period by measuring the voltage and current of its output under motor load conditions.

The power supply 314 and 316 are electric power supplies. For example, the power supply 314 and/or 316 may be a 3-phase AC supply at 200, 400, 440 or 600 Volts, for example, or in the ranges of about 200-208 V, 220-240 V, 380-415 V, 440-480 V, and 550-600 V, and can draw thousands of amps of current. For a supported voltage range, the fire pump controller 310 (and/or jockey pump controller 312) may be fully operational over a voltage span of about 85% of a lowest nominal to about 110% of a high nominal (e.g., 170-660 Vac).

In both examples, the fire pump 302 and the jockey pump 308 may be cycled on and off to boost and/or maintain proper system pressure in the fire protection system 306

In addition, because of the requirement that the system 300 be ready at any time, monitoring the status of the system and the raising of alarms may be required. For example, system operability may be monitored, and pre-emptive alarms can be used to insure that the system 300 is ready for use at all times. The fire pump controller 310 (and/or jockey pump controller 312) may perform functions of monitoring a pressure of the sprinkler system, storing the measured pressure, and causing the fire pump 302 (or jockey pump 308) to turn on if the pressure is less than a threshold amount. The fire pump controller 310 (and/or jockey pump controller 312) may turn the fire pump 302 (or jockey pump 308) off when the pressure is restored or is too high, and may trigger alarms to signal that the system is not at a normal range.

The fire pump controller 310 (and/or jockey pump controller 312) may further monitor a voltage and/or current from the power supply 314 (or power supply 316) and trigger an alarm if the voltage source is operating outside of a given range. Current on all three phases of the power source may be monitored when the pump is running.

In some examples, the fire pump controller 310 (and/or jockey pump controller 312) may monitor a voltage and/or current of an associated power supply, and provide a visual indication of the voltage and/or current. For example, graphic displays of the motor power supply voltage and current traces can be provided that illustrate the load demands of the motor upon the output of the power supply. In some examples, the graphic displays of motor power supply voltage and current traces can be provided that may illustrate the load demands of the motor upon the output of the power supply in the first ten seconds of starting the motor. Thus, the pump controllers may monitor, display, and record fire pump system information.

Figure 4:
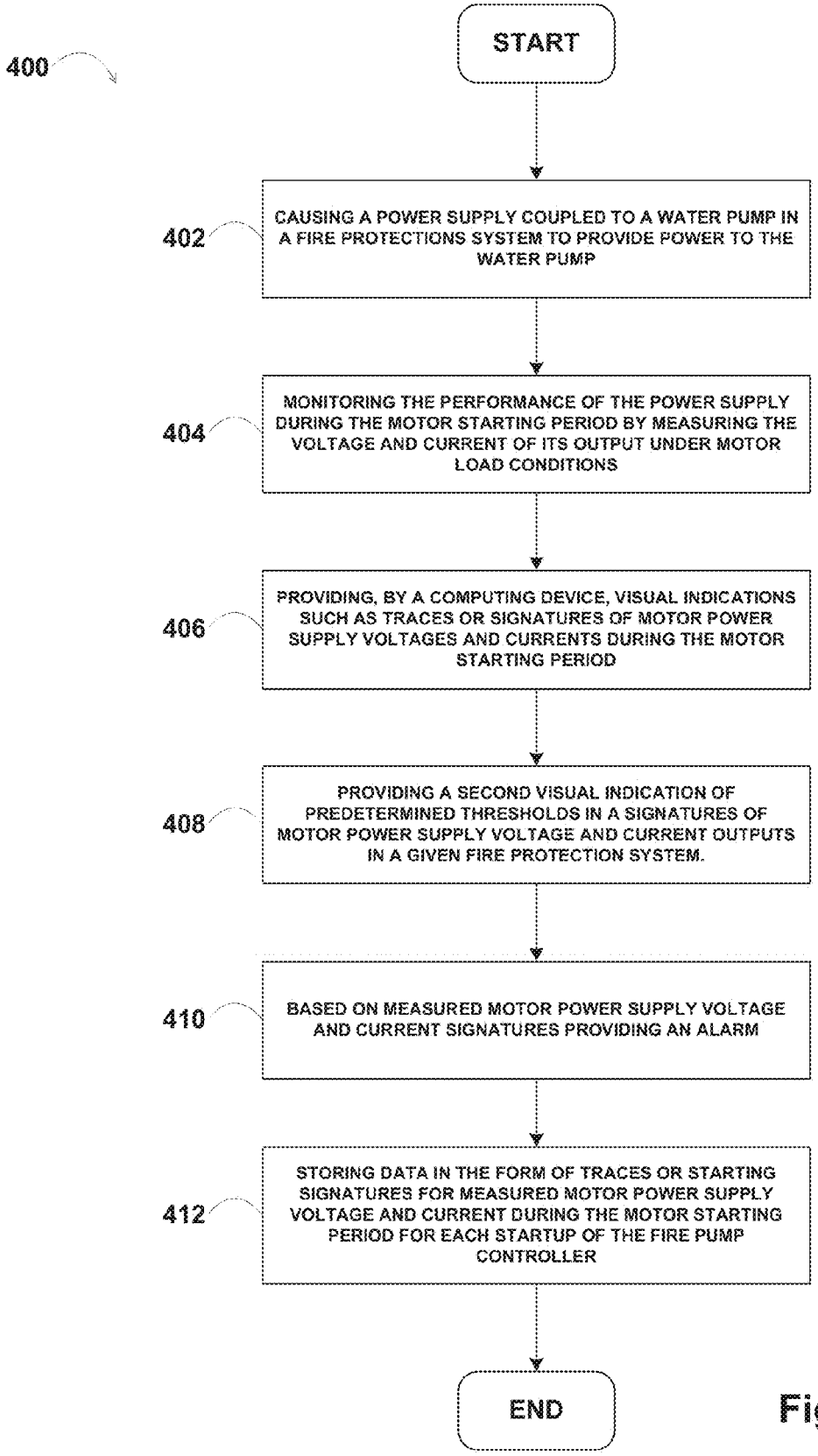
FIG. 4 is a flow chart of an example method for monitoring the performance of the fire pump power supply during the motor starting period by measuring the voltage and/or current of its output under motor load conditions.

FIG. 4 is a flow chart of an example method 400 for monitoring the power supply output to a fire pump motor. For instance, the pump motor may be a fire pump motor for driving fire pump 302 or a jockey pump motor for driving a jockey pump 308 FIG. 3. The method 400 may be performed by a fire pump controller, such as a main fire pump controller (e.g., the fire pump controller 310 in FIG. 3) or a jockey pump controller (e.g., the jockey pump controller 312 in FIG. 3). Method 400 shown in FIG. 4 presents an embodiment of a method that could be used by the system 200 of FIG. 2 or the system 300 of FIG. 3, or components of the system 200 or system 300, for example. It should be understood that for this and other processes and methods disclosed herein, the flowchart shows functionality and operation of one possible implementation of present embodiments. In this regard, each block may represent a module, a segment, or a portion of program code, which includes one or more instructions executable by a processor or computing device for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and random access memory (RAM). The computer readable medium may also include non-transitory media, such as secondary or persistent long term storage, like read only memory (ROM), optical or magnetic disks, or compact-disc read only memory (CD-ROM), for example. The computer readable media may also be any other volatile or non-volatile storage systems, or other articles of manufacture. The computer readable medium may be considered a computer readable storage medium, for example, or a tangible storage device.

In addition, for the method 400 and other processes and methods disclosed herein, each block may represent circuitry that is wired to perform the specific logical functions in the process. Alternative implementations are included within the scope of the example embodiments of the present disclosure in which functions may be executed out of order from that shown or discussed, including substantially concurrent or in reverse order, depending on the functionality involved, as would be understood by those reasonably skilled in the art.

Initially, as shown at block 402, the method 400 includes causing a power supply coupled to a water pump through a pump controller in a fire protection system to provide power to the water pump. For example, a pump controller may connect the pump motor to the power supply or cause the power supply to begin operation in the case of a standby generator. The power supply may then provide power to a pump, so that the pump may operate as required.

At block 404, the method includes monitoring the performance of the power supply during the motor starting period by measuring the voltage and/or current of its output under motor load conditions. In one example, the electric motor-driven pump is coupled to the power supply through the pump controller. Coupling the motor to the supply through the controller permits the controller to measure power supply voltage and/or current through its internal sensing lines. In some examples, the pump controller may be configured to monitor the performance of the power supply during the motor starting period by measuring the voltage and current of its output under motor load conditions At block 406, the method includes providing, by a computing device, visual indications, such as traces of motor power supply voltages and currents during the motor starting period. In one example, the computing device may comprise a pump controller, and the pump controller may include a display configured to display the visual indication.

Figure 5A:
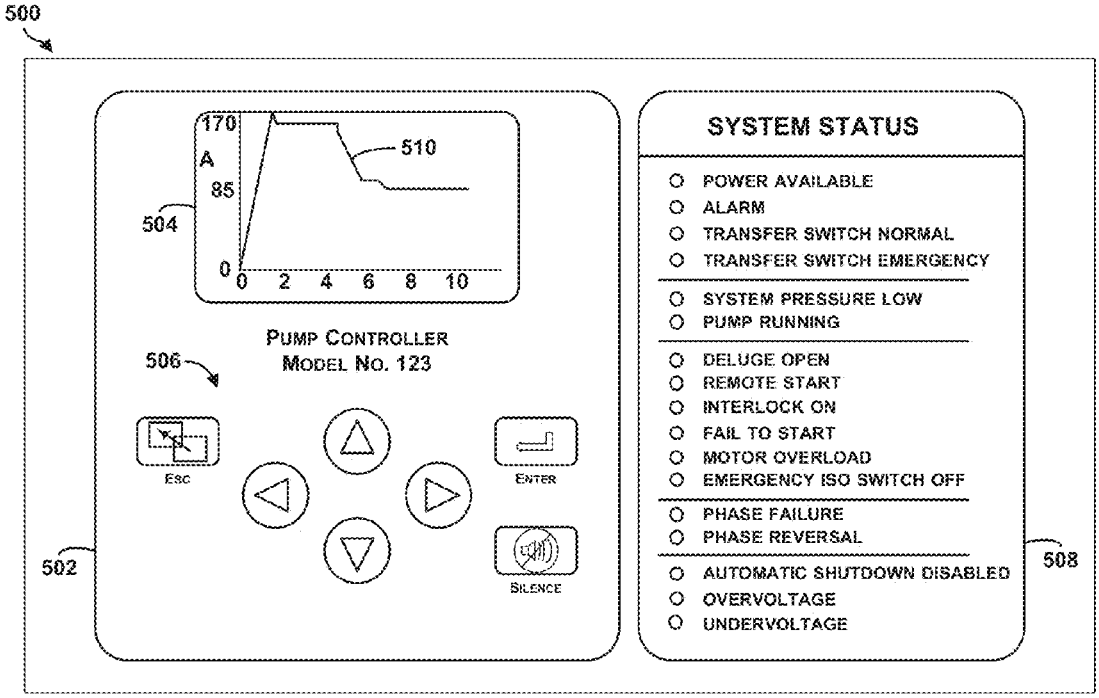
FIGS. 5A-5B are examples of pump controller operator interfaces illustrating visual indications of motor voltage and/or current in the form of traces or starting signatures.
Figure 5B:
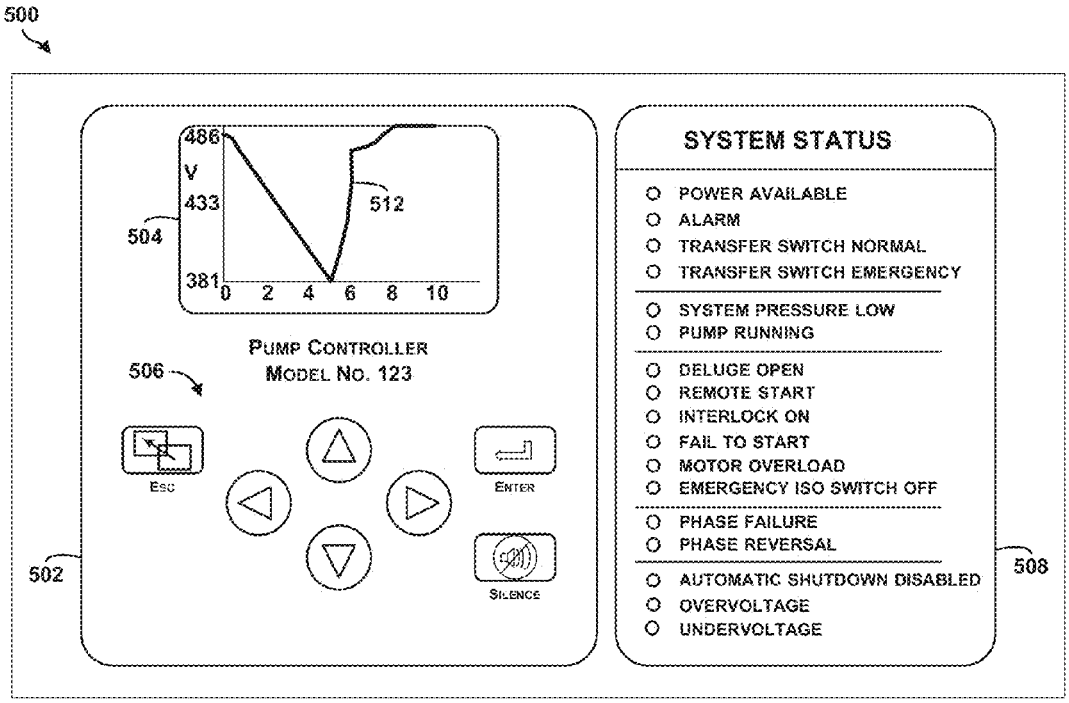

FIGS. 5A-5B are an example pump controller interface 500. In some examples, the interface 500 may be used by an operator to operate a fire pump controller and/or a jockey pump controller. The interface may be coupled to a fire pump controller or jockey pump controller, for example, or may be provided at a location remote from a fire pump system. The interface 500 may include an electronic control board 502 having a display 504 and a keypad 506, and an alarm panel 508.

In one example, the display 504 may be a backlit, liquid crystal (LCD) display. For example, the display 504 may be a monochrome or multi-chromatic dot matrix 128×64 LED display. Other example sizes are also possible. The display 504 may be configured to display customized graphics and/or characters. For instance, the display 504 may provide information associated with time and date, system pressure, pump operation timers, three-phase power supply line voltages, etc. In some examples, the display 504 may provide text messages for the statistics or alarm conditions for one or more of the following: motor on, minimum run time, off delay time, fail to start, under voltage, locked rotor trip, emergency start, drive not installed, disk error, disk near full, sequential start time, local start, remote start, system battery low, over voltage, over frequency, motor over 320%, motor overload, printer error, pressure error, etc.

The interface 500 may be configured to provide the visual indication on the display 504. The visual indication may take many forms and may include or convey a number of different types of information. As one example, the visual indication may indicate whether a timed acceleration of the pump motor to full speed exceeded about ten seconds during a starting period of the motor. In this example, the pump controller may be configured to determine an amount of time required for the motor to reach full speed by measuring motor power supply voltage and current during the starting period.

Based on the measurements, the pump controller may be configured to determine other information as well, such as whether a voltage provided by the power supply is less than about 15 percent of a nominal operating voltage under motor starting conditions. Nominal operating voltages may vary based on sizes of the power supply and water pumps. The pump controller may then provide a visual indication of any information that is determined, such as an indicator for failure to remain above 15 percent of operating voltage during motor starting or a digital readout of measured motor power supply voltage and current during motor starting, for example. A motor starting period may include about a first ten seconds of operation, however, shorter or longer time periods may be used for such determinations.

The pump controller may be further configured to generate a graph illustrating a magnitude of the motor power supply voltage and current during motor starting. The visual indication may then include the graph. The graph may be tailored for the display based on fire protection system requirements so as to display traces of motor power supply voltage and current during the motor starting period and zoomed in on specific aspects relevant to the requirements or scaled to illustrate the relevant portions of the trace.

FIG. 5A illustrates an example current trace (or starting signature) 510 on the display 504. The graph in the display 504 is configured to illustrate the current trace 510 using magnitudes of between about 0-170 Amps and over a time period of about ten seconds. Thus, the current trace or starting signature 510 provides a systems operator with an observation of motor current drawn from the power supply during the motor starting period. In this example, a large amount of current is initially required to start the motor. For example, in this illustrated arrangement, starting or inrush motor current is approximately 170 Amps. Motor current falls off to about 85 Amps as the motor reaches full speed for example.

FIG. 5B illustrates an example voltage trace or starting signature 512 on the display 504. The graph in the display 504 is configured to illustrate the voltage trace or starting signature 512 using magnitudes of between about 381-486 Volts and over a time period of about ten seconds. Thus, the voltage trace or starting signature provides the operator with an observation of power supply voltage resulting from the current demand upon the power supply during the motor starting period, and magnitudes at levels relevant to fire protection system requirements. In this example, there is initially a large voltage drop as a result of the initial starting current drawn by the motor during the motor starting period. Motor voltage decreases as the motor draws less and less current from the power supply in coming up to full speed.

The pump controller may be further configured to compare the trace or starting signature (or graph) to a library of stored motor starting signatures that indicate predetermined thresholds for the various motor starting configurations approved for use in standard fire protection systems.

The visual indication may then include an indication of whether the measured power supply motor voltage and current traces or meet the predetermined thresholds of the motor starting signatures in the library.

Referring back to FIG. 4, at block 408, the method 400 includes providing a second visual indication of predetermined thresholds for motor power supply voltage and current under motor starting conditions from a library of standard motor starting signatures. As an example, the second indication may be in addition to the first indication (and provided on the same or a separate display), or the second indication may replace the first indication. The second indication (or standard signature from the library) may indicate expected or desired motor power supply starting voltage and current for a given motor starting method in the fire protection system so that a user may readily compare measured power supply outputs with expected or desired starting signatures to determine whether a problem exists. Thus, in some examples, the pump controller may be configured to display indications of standard signatures for a given motor starting method in a fire protection system that is operating as expected or desired.

The pump controller may be configured to make a determination of whether the measured motor power supply voltage and current traces exceed predetermined thresholds from the standard motor starting signatures resident in the library and provide a result of the determination as the second indication.

At block 410, the method 400 includes based on measured motor power supply voltage and current signatures providing an alarm. As an example, the pump controller can make determinations of whether monitoring the performance of the power supply during the motor starting period by measuring the voltage and current of its output under motor load conditions are within acceptable levels, and responsively provide an alarm when the measurements are outside of acceptable levels.

Referring to FIG. 5A, the interface 500 includes the alarm panel 508, which may comprise a plurality of LEDs configured to indicate system status or alarm conditions. In some instances, one or more of the LEDs may be capable of displaying a red, green, or yellow light based on various conditions determined by a microprocessor of a pump controller. For instance, a color or illumination of an LED of the plurality of LEDs may indicate one or more of the following: power available, pump running, remote start, deluge open, phase failure, interlock on, motor overload, automatic shutdown disabled, overvoltage, alarm, system pressure low, transfer switch normal, transfer switch emergency, phase reversal, fail to start, emergency isolation switch off, undervoltage, etc. The alarm panel 508 may include alarms specific to indicating motor startup voltage and/or current levels being outside of acceptable levels, for example.

At block 412, the method 400 includes storing data in the form of traces or starting signatures for measured motor power supply voltage and current during the motor starting period for each startup of the fire pump controller. The pump controller may include data storage (e.g., memory) for storing data, and such data may be retrieved and analyzed over time to determine whether the fire protection system is operating properly. As an example, the pump may be tested on a quarterly basis, and if the pump was started ten times in the past quarter, the data can be retrieved for processing and trouble-shooting to determine where problems exist. For instance, stored data may be analyzed to identify trends or other issues during startup of the fire pump.

The method 400 may be performed by a pump controller as a diagnostic or troubleshooting tool for verifying proper performance of various fire protection systems or components or functions of fire protection systems, such as reduced-voltage motor starting methods, analyzing voltage drop of power supplies, and sizing of alternate power supplies such as standby generators supplying fire pump controllers equipped with transfer switches, for example.

The National Fire Protection Association (NFPA) has released standards for installation and operation of fire pumps as the "NFPA 20: Standard for the Installation of Stationary Pumps for Fire Protection" (NFPA20-2010), the entire contents of which are incorporated herein. The standards indicate a number of requirements to be satisfied for operation of a fire protection system. One requirement includes that a voltage at a controller line terminal shall not drop more than fifteen percent below normal (controller-rated voltage) under motor-starting conditions. Another requirement includes that voltage at the motor terminals shall not drop more than five percent below the voltage rating of the motor when the motor is operating at 115 percent of the full-load current rating of the motor. Additional requirements specific to motor starting, such that the fire protection system may be initiated immediately upon determination of a fire, include that a timed automatic acceleration of the motor shall be provided and a period of motor acceleration shall not exceed ten seconds. Thus, the pump may need to be ready to run within about ten seconds after receiving power, and if power has been interrupted and then returns, and there is an existing "call to start" condition (e.g., low water pressure in the system) the controller has to recognize this condition and start the operation sequence within ten seconds from supply of power.

Other standards also may provide requirements for operation of a fire protection system. For example, the National Electric Code (NEC) 2011, the entire contents of which are incorporated herein, states that a voltage at the fire pump controller line terminals shall not drop more than fifteen percent below normal (controller-rated voltage) under motor starting conditions. National Electrical Manufacturers Association (NEMA) has also published an application guide for electric fire pump controller (NEMA ICS14-2010) and instructions for handling, installation, operation, and maintenance for electric fire pump controllers (NEMA ICS15-2011), the entire contents of each of which are incorporated herein.

These requirements provide limitations on operation of a fire protection system. In examples herein, the pump controllers may monitor the fire protection system and provide visual indications of motor power supply voltage and current output relevant to the requirements. The method 400 may be performed, for example, to verify whether a fire protection system is operating according to requirements.

One requirement of interest is a starting time of the electric motor-driven fire pump. There are many starting methods or techniques for starting a fire pump motor including Full Voltage Across-the-Line starting (DOL), and reduced voltage starting methods such as Part Winding, Wye-Delta Open Transition, Wye-Delta Closed Transition, Primary Resistance, Autotransformer, and Solid State Soft Start.

Figure 6:
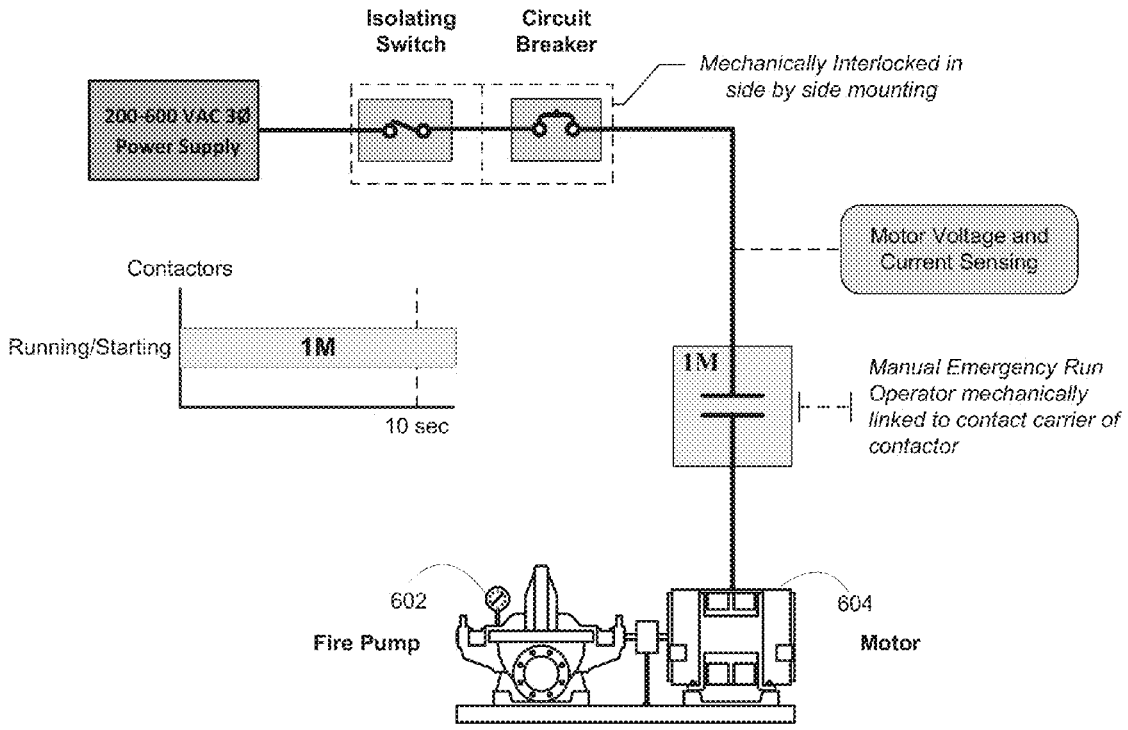
FIG. 6 is an example full voltage starting controller diagram and associated current trace or signature for a full voltage motor starting method.
Figure 6:
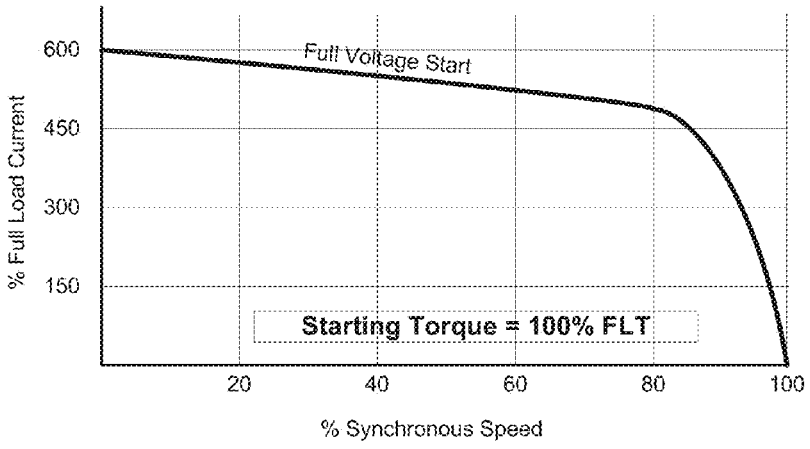

An example Full Voltage Starting controller diagram is shown in FIG. 6. A power supply 600 is coupled through switches and circuit breakers to a fire pump 602. When called to start, a controller (not shown) applies full voltage to a motor 604 driving the fire pump 602. The motor 604 draws a maximum starting current, e.g., about 600% of motor full load current, and delivers maximum design torque to the fire pump 602. Full voltage starting may be used when a motor starting current will not cause excessive decrease in power supply voltage at controller line terminals. If full voltage starting motor current causes a line voltage to drop to less than about 85% of rated voltage, then a reduced voltage starting method is used. FIG. 6 illustrates an example current trace or signature as would be expected using the full voltage starting method.

Reduced voltage starting methods can also be used in which a starting current is reduced (even though referred to as "reduced voltage starting method"), thus causing less demand on a power supply and allowing line voltage to remain between 85% and 100% of rated voltage. Example reduced voltage starting methods employ combinations of starting and running contactors controlled by a transition timer (or acceleration timer) to bring a motor up to full speed within about ten seconds of starting as required.

Figure 7:
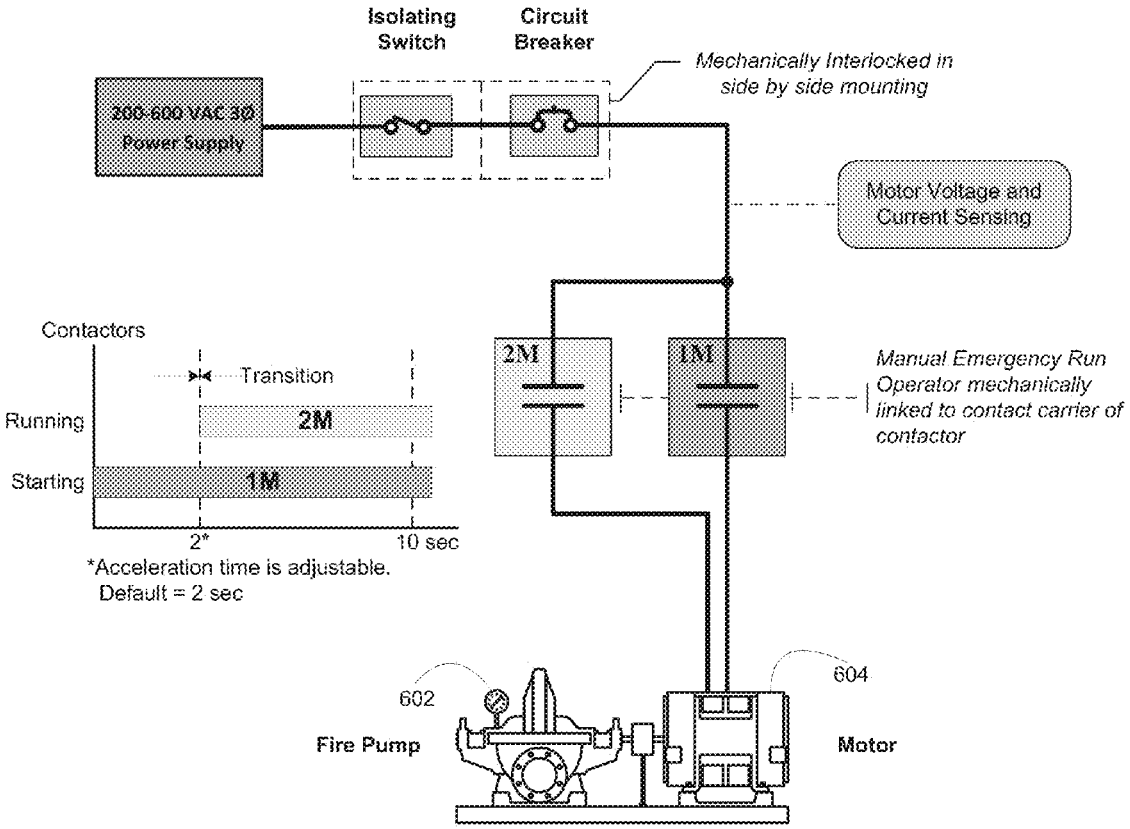
FIG. 7 is an example part winding starting controller diagram and associated current trace or signature for a part winding motor starting method.
Figure 7:
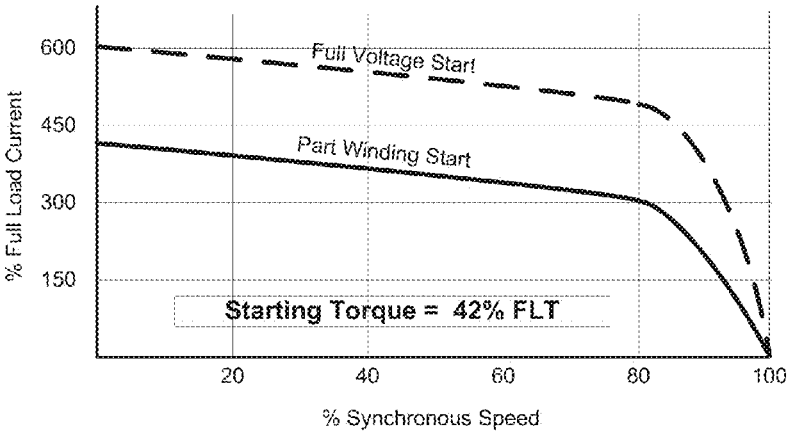
Figure 8:
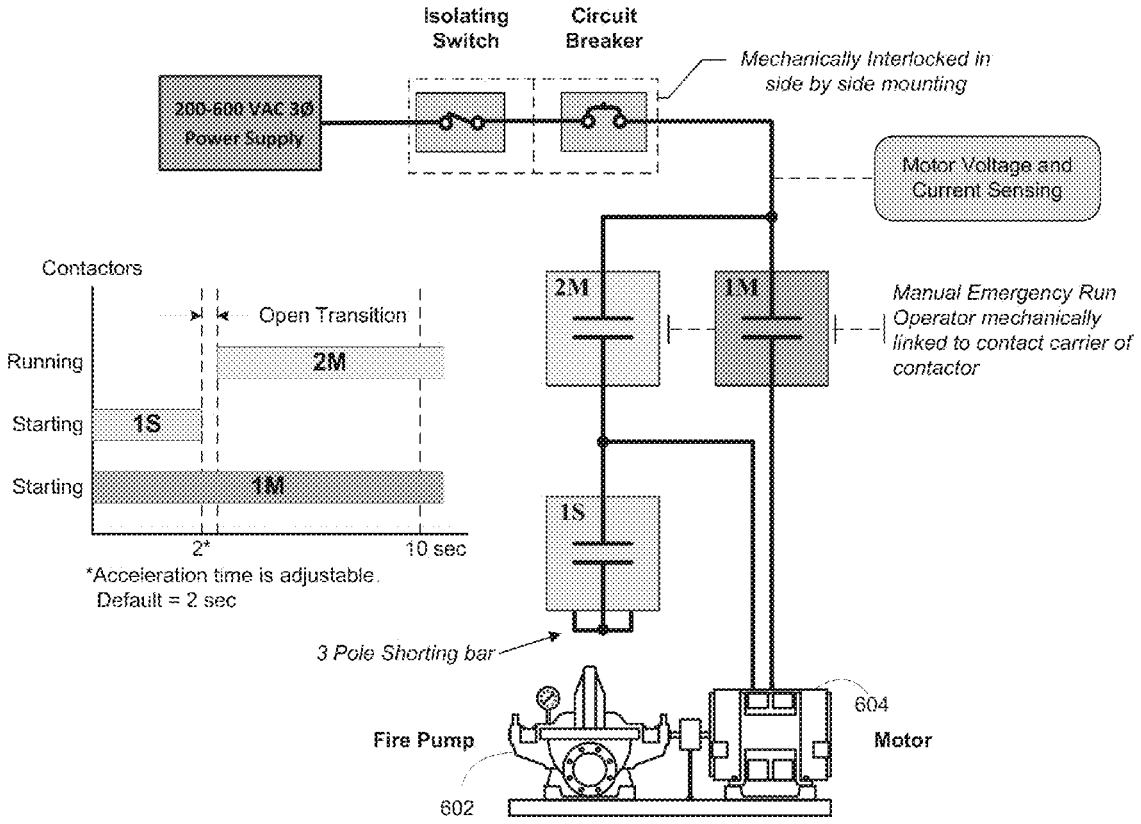
FIG. 8 is an example Wye-Delta Open Transition starting controller diagram and associated current trace or signature for a Wye-Delta Open Transition motor starting method.
Figure 8:
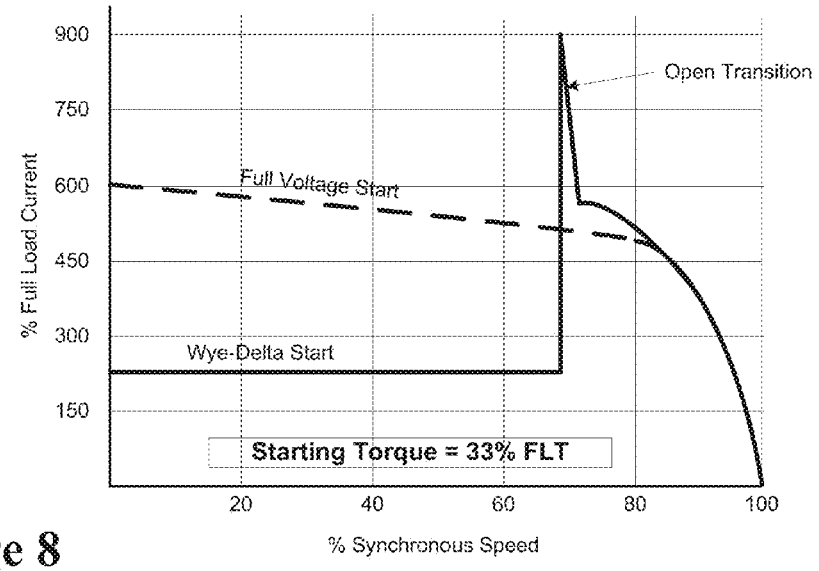
Figure 9:
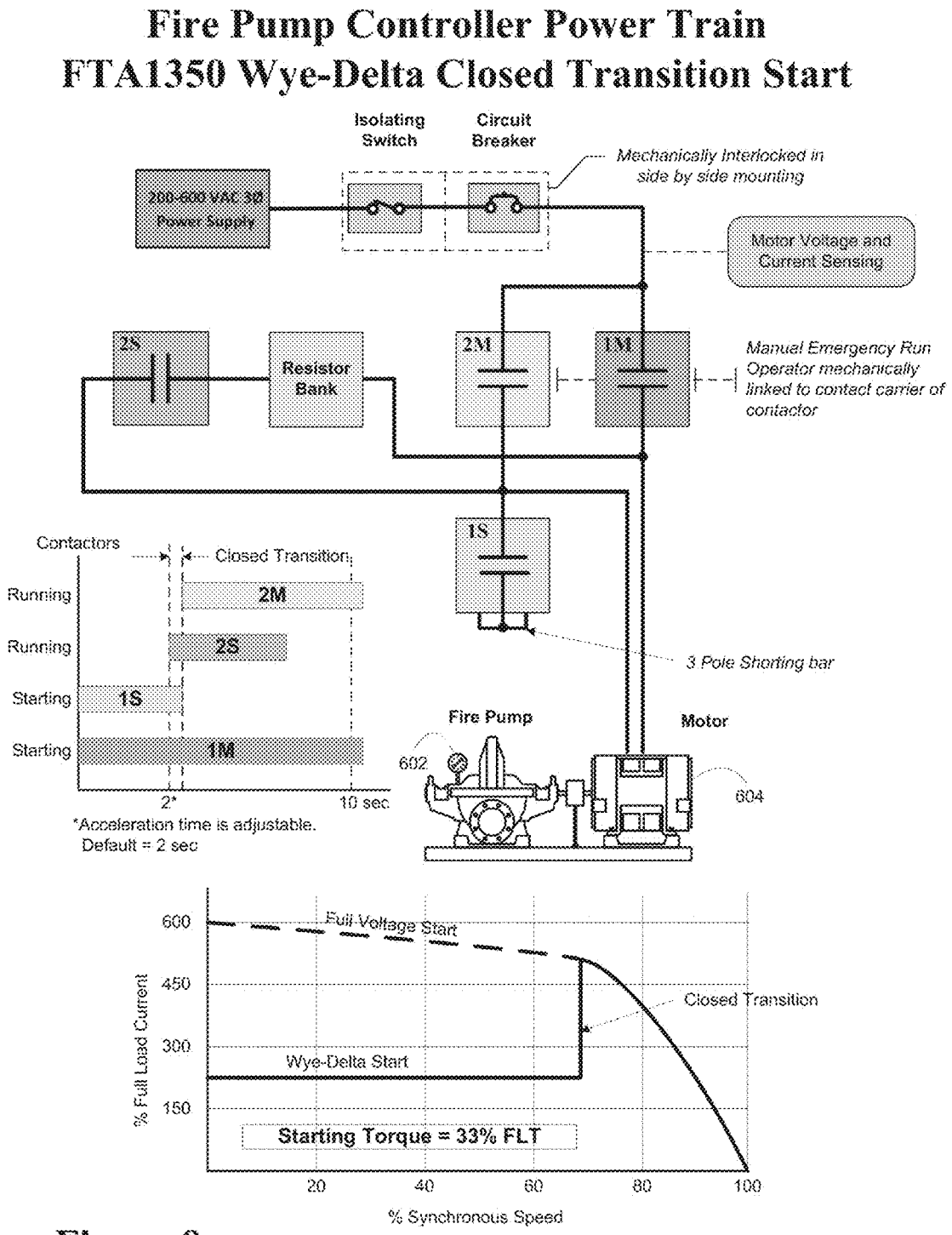
FIG. 9 is an example Wye-Delta Closed Transition starting controller diagram and associated current trace or signature for a Wye-Delta Closed Transition motor starting method.
Figure 10:
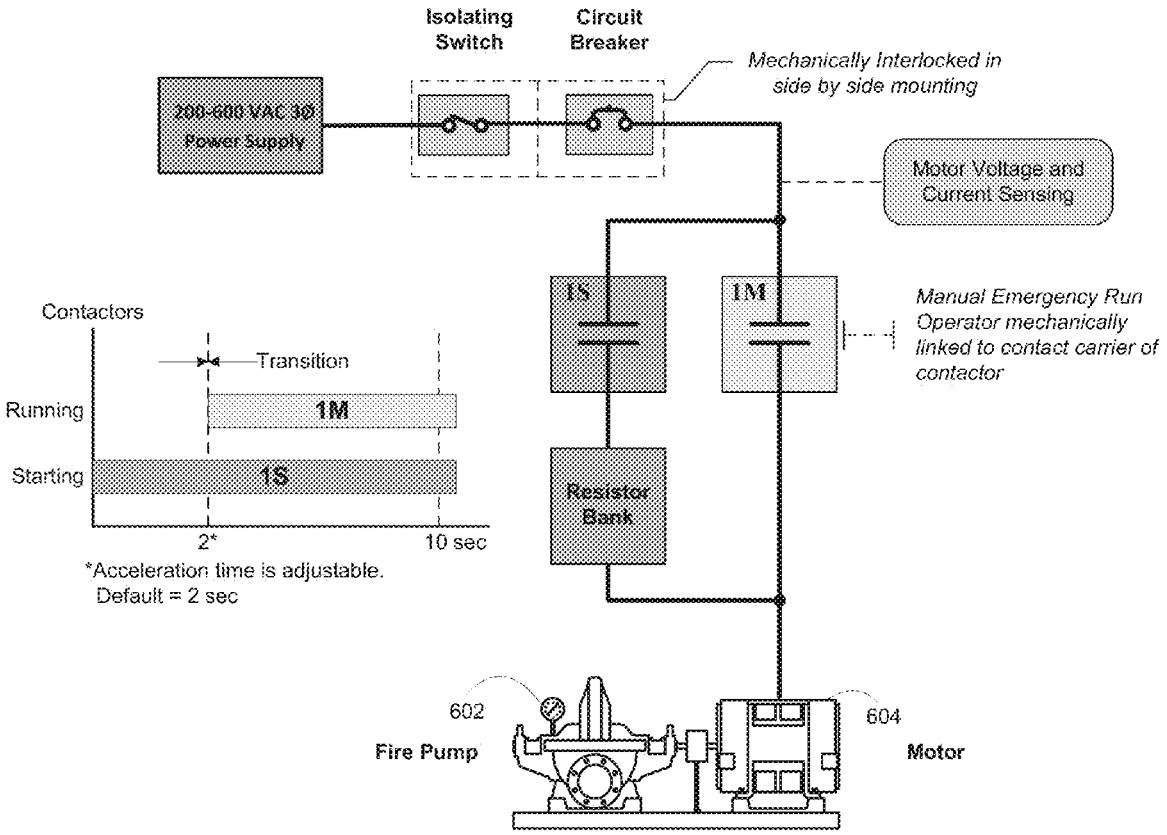
FIG. 10 is an example primary resistance starting controller diagram and associated current trace or signature for a primary resistance motor starting method.
Figure 10:
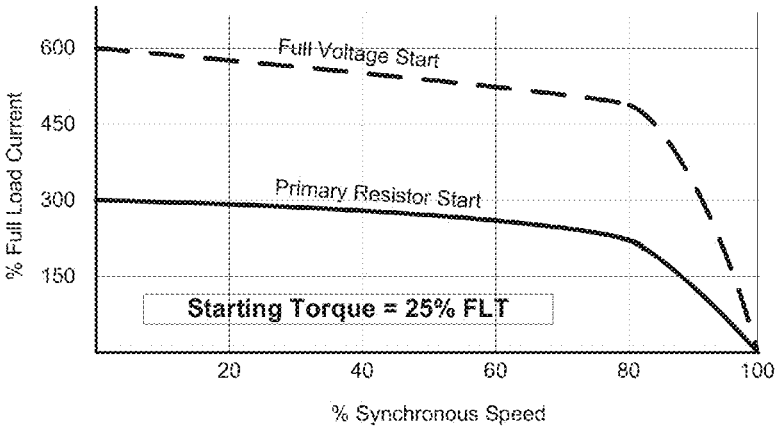
Figure 11:
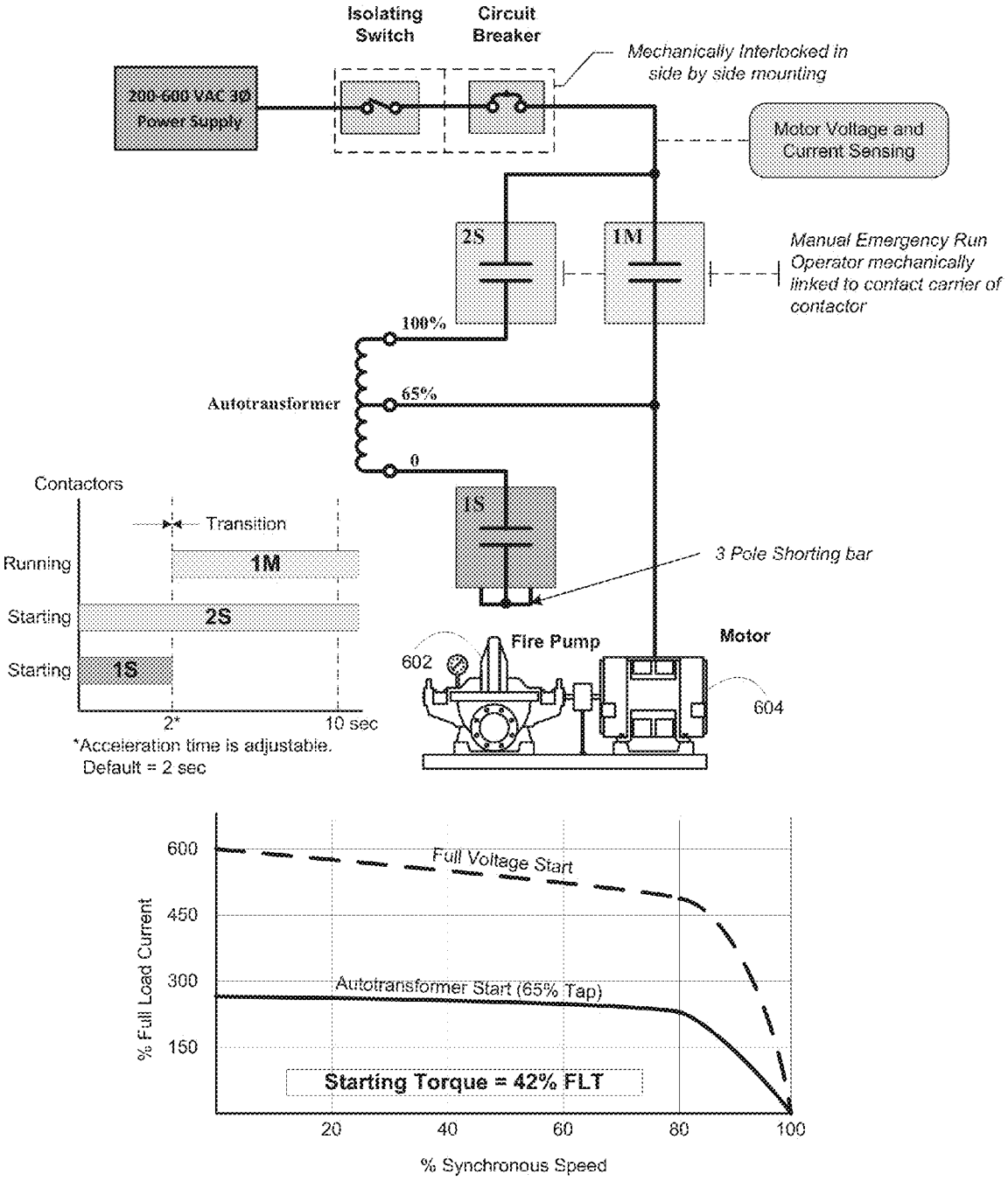
FIG. 11 is an example autotransformer starting controller diagram and associated current trace or signature for an autotransformer motor starting method.
Figure 12:
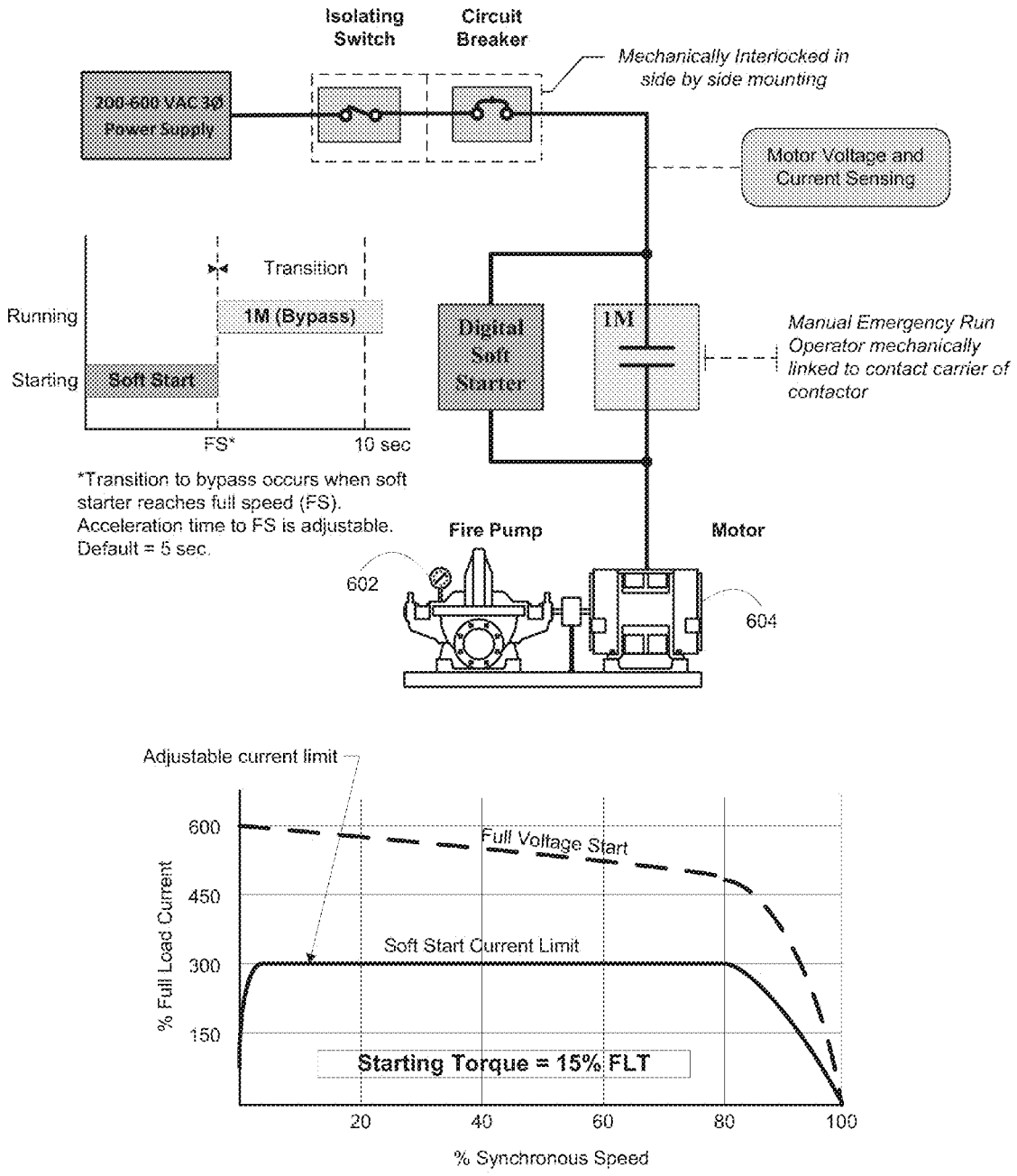
FIG. 12 is an example solid state soft start starting controller diagram and associated current trace or signature for a solid state soft start motor starting method.

An example part winding starting controller diagram and associated current signature for a part winding starting method is shown in FIG. 7. An example Wye-Delta Open Transition starting controller diagram and associated current signature for a Wye-Delta Open Transition starting method is shown in FIG. 8. An example Wye-Delta Closed Transition starting controller diagram and associated current signature for a Wye-Delta Closed Transition starting method is shown in FIG. 9. An example primary resistance starting controller diagram and associated current signature for a primary resistance starting method is shown in FIG. 10. An example autotransformer starting controller diagram and associated current signature for an autotransformer starting method is shown in FIG. 11. An example solid state soft start starting controller diagram and associated current signature for a solid state soft start starting method is shown in FIG. 12. Descriptions of specifics of each of these starting methods are provided in the incorporated standards described above which are herein entirely incorporated by reference and to which the reader is directed for further information.

An example chart comparing the different fire pump starting methods is shown below in Table 1.

TABLE 1

| Type of Controller | Approx. Cost Index | Line Starting Current % FLA | Initial Starting Torque % Full Load Torque | Type of Motor |
|---|---|---|---|---|
| FTA1000 Full Voltage | 100 | 600% | 100% | Standard |
| FTA1250 Part Winding | 125 | 390% | 42% | 6 or 12 Lead |
| FTA1300 Wye-Delta Open Transition | 130 | 200% | 33% | 6 or 12 Lead |
| FTA1350 Wye-Delta Closed Transition | 185 | 200% | 33% | 6 or 12 Lead |
| FTA1500 Primary Resistor | 150 | 300% | 25% | Standard |

TABLE 1-continued

| Type of Controller | Approx. Cost Index | Line Starting Current % FLA | Initial Starting Torque % Full Load Torque | Type of Motor |
|---|---|---|---|---|
| FTA1800 Autotransformer | 200 | 225% | 42% | Standard |
| FTA1930 Digital Soft Start | 180 | 300% | 15% | Standard |

Each of the example current signatures in FIGS. 6-12 may be considered typical traces of motor currents drawn from a power supply for the respective starting conditions.

The pump controller may be configured using operator parameters, such as those listed below in Table 2, to configure a display of information.

TABLE 2

| | |
|---|---|
| Startup Time | 10 s |
| Sampling Rate | 64 ms |
| Voltage Minimum | 0 V |
| Current Minimum | 479 A |
| Voltage Graph | Select |
| Current Graph | Select |

A startup time may configure a range over which to monitor power supply voltage and motor current drawn from the power supply. A startup time of ten seconds may be a default, however, the startup time can be adjusted to any amount. A sampling rate may indicate a period between measurements that is fixed at 64 milliseconds, or can be adjusted to any amount. A voltage minimum is a measurement of a voltage captured during a last startup of the motor. A current maximum is a measurement of a peak current captured during a last startup of the motor. A voltage graph or a current graph may be selected for observation on a display.

The pump controller can store the industry standard starting signatures in a library (examples shown in FIGS. 6-12) and make comparisons of generated traces with the stored signatures. In one example, a user may select a motor startup method, initiate startup of the pump to measure startup voltages and current, and determine motor voltage and current traces based on the measurements. The pump controller may further be configured to retrieve a signature of the selected startup method from the library in memory, compare the measured trace with the stored signature, and identify an amount of differences between the two traces. The pump controller may further be configured to determine whether the measured motor power supply voltages and currents are outside of acceptable levels based on the comparison, and provide an alarm.

The pump controller can be configured to provide visual indicators (e.g., graphs, traces, signatures) of motor power supply voltage and/or current that cover desired ranges of starting times. For example, a transition between starting contactors and running contactors has a transition timer set at about two seconds, and thus, a technician may zoom in on a transition by changing a time base on a display of the pump controller to about five seconds full scale. In some examples, investigation of a current spike occurring in the FTA1300 Wye-delta Open Transition Controller as a result of opening a motor circuit during transition from starting to running can be performed. Current transients of more than about 800% FLA can be possible and may result in damage to equipment, for example, in cases of stand-by generator usage as an emergency supply in a fire pump controller equipped with a transfer switch.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

What is claimed is:

1. A method comprising:

causing a power supply coupled to an electric motor-driven water pump in a fire protection system to provide power to the water pump;

measuring a voltage and/or current of the motor power supply output;

providing, by a computing device, at least one visual indication comprising a trace of motor power supply voltage and/or current output during a motor starting period; and storing data in the form of traces or signatures for motor power supply voltage and/or current during the motor starting for each startup of the fire protection system.

2. The method of claim 1, wherein causing the power supply coupled to the water pump in the fire protection system to provide power to the water pump comprises causing the power supply to begin operation.

3. The method of claim 1, wherein measuring the voltage and/or current of the motor power supply output comprises measuring the voltage and/or current of the motor power supply output during a starting period of the power supply.

4. The method of claim 1, wherein providing the at least one visual indication comprising the trace of motor power supply voltage and/or current output comprises providing an indication of whether a voltage provided by the power supply is less than 15 percent of a nominal operating voltage under starting conditions, wherein the nominal operating voltage is based on a size of the power supply and the electric motor-driven water pump.

5. The method of claim 1, further comprising providing the at least one visual indication comprising the trace of motor power supply voltage and/or current output corresponding to motor power supply voltage and/or current output during a starting period of the power supply.

6. The method of claim 5, wherein the starting period of the power supply comprises a first ten seconds of operation of the power supply.

7. The method of claim 1, further comprising, based on the information indicating motor power supply voltage and/or current output, providing an alarm.

8. The method of claim 1, further comprising generating a graph illustrating a magnitude of the motor power supply voltage and/or current output during a starting period of the motor.

9. The method of claim 8, further comprising displaying the graph on a display.

10. A method comprising:

causing a power supply coupled to an electric motor-driven water pump in a fire protection system to provide power to the water pump;

measuring a voltage and/or current of the motor power supply output;

providing, by a computing device, at least one visual indication comprising a trace of motor power supply voltage and/or current output during a motor starting period;

generating a graph illustrating a magnitude of motor power supply voltage and/or current output during a starting period of the motor;

displaying the graph on a display;

comparing the graph to stored graphs or a starting signature, wherein the stored graphs are indicative of predetermined thresholds for voltage and/or current outputs of a given motor power supply in a given fire protection system; and providing an indication whether the motor power supply voltage and/or current output meet the predetermined thresholds.

11. The method of claim 1, further comprising providing a second visual indication of predetermined thresholds for motor power supply voltage and/or current output in a given fire protection system.

12. A method comprising:

causing a power supply coupled to an electric motor-driven water pump in a fire protection system to provide power to the water pump;

measuring a voltage and/or current of the motor power supply output;

providing, by a computing device, at least one visual indication comprising a trace of motor power supply voltage and/or current output during a motor starting period;

making a determination of whether the motor power supply voltage and/or current output exceed predetermined thresholds for motor power supply voltage and/or current output in a given fire protection system; and providing a second visual indication or starting signature of a result of the determination.

13. A method comprising:

causing a power supply coupled to an electric motor-driven water pump in a fire protection system to provide power to the water pump;

measuring a voltage and/or current of the motor power supply output;

providing, by a computing device, at least one visual indication comprising a trace of motor power supply voltage and/or current output during a motor starting period; and providing a second visual indication of a standard model starting signature of a given power supply in a given fire protection system.

14. A method comprising:

causing a power supply coupled to an electric motor-driven water pump in a fire protection system to provide power to the water pump;

measuring a voltage and/or current of the motor power supply output;

providing, by a computing device, at least one visual indication comprising a trace of motor power supply voltage and/or current output during a motor starting period; and providing an indication of whether a timed acceleration of the pump motor to full speed exceeded ten seconds during a starting period of the motor, wherein the timed acceleration of the motor is indicative of an amount of time required to cause the power supply to bring the motor up to speed and provide power to the water pump.

15. A method comprising:

causing a power supply coupled to an electric motor-driven water pump in a fire protection system to provide power to the water pump;

measuring a voltage and/or current of the motor power supply output;

providing, by a computing device, at least one visual indication comprising a trace of motor power supply voltage and/or current output during a motor starting period;

receiving a selection of a startup method;

causing the power supply to provide power to the water pump using the selected startup method;

measuring the voltage and/or current of the motor power supply output using the selected startup method;

comparing the information from a starting signature of the selected startup method indicating the voltage and/or current of the motor power supply output with the measured voltage and/or current of the motor power supply output; and providing the visual indication a result of the comparison.

* * * * *